US009958161B2

(12) United States Patent
Prociw et al.

(10) Patent No.: US 9,958,161 B2
(45) Date of Patent: May 1, 2018

(54) COMBUSTOR FOR GAS TURBINE ENGINE

(71) Applicant: PRATT & WHITNEY CANADA CORP., Longueuil (CA)

(72) Inventors: Lev Alexander Prociw, Johnston, IA (US); Tin Cheung John Hu, Markham (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 781 days.

(21) Appl. No.: 13/795,082

(22) Filed: Mar. 12, 2013

(65) Prior Publication Data

US 2014/0260266 A1 Sep. 18, 2014

(51) Int. Cl.

| | |
|---|---|
| ***F23R 3/28*** | (2006.01) |
| ***F23R 3/00*** | (2006.01) |
| ***F23R 3/50*** | (2006.01) |
| ***F23R 3/10*** | (2006.01) |

(52) U.S. Cl.

CPC ..... *F23R 3/286* (2013.01); *F23R 3/002* (2013.01); *F23R 3/10* (2013.01); *F23R 3/50* (2013.01)

(58) Field of Classification Search

CPC .... F23R 3/10; F23R 3/50; F23R 3/286; F23R 3/002; F23R 3/04; F23R 3/06; F23R 2900/03042; F23R 2900/03043; F02C 7/12; F02C 7/18; F05D 2260/20

USPC ..... 60/752–760

See application file for complete search history.

(56) References Cited

U.S. PATENT DOCUMENTS

| | | | | |
|---|---|---|---|---|
| 3,134,229 | A * | 5/1964 | Johnson | F23R 3/04 60/748 |
| 3,213,523 | A | 10/1965 | Boehler | |
| 3,653,207 | A | 4/1972 | Stenger | |
| 4,058,977 | A | 11/1977 | Markowski | |
| 4,150,539 | A | 4/1979 | Rubins et al. | |
| 4,192,139 | A | 3/1980 | Buchheim | |
| 4,253,301 | A | 3/1981 | Vogt | |
| 4,260,367 | A | 4/1981 | Markowski | |
| 4,265,615 | A | 5/1981 | Lohmann | |
| 4,292,801 | A | 10/1981 | Wilkes et al. | |
| 4,301,657 | A | 11/1981 | Penny | |
| 4,420,929 | A | 12/1983 | Jorgensen et al. | |
| 4,498,288 | A | 2/1985 | Vogt | |
| 4,499,735 | A | 2/1985 | Moore | |
| 4,603,548 | A | 8/1986 | Ishibashi et al. | |
| 4,898,001 | A | 2/1990 | Kuroda et al. | |
| 4,984,429 | A * | 1/1991 | Waslo | F23R 3/346 60/752 |

(Continued)

FOREIGN PATENT DOCUMENTS

| | | |
|---|---|---|
| EP | 1705426 A1 | 9/2006 |
| EP | 1775516 A2 | 4/2007 |

(Continued)

*Primary Examiner* — Craig Kim

(74) *Attorney, Agent, or Firm* — Norton Rose Fulbright Canada LLP

(57) ABSTRACT

A gas turbine engine comprises an annular combustor chamber formed between an inner liner and an outer liner. An annular upstream zone is adapted to receive fuel and air from an annular nozzle. An annular mixing zone is located downstream of the upstream zone. The mixing zone has a reduced radial height relative a downstream combustion zone of the combustion chamber, the mixing zone defined by straight wall sections.

20 Claims, 4 Drawing Sheets

(56) References Cited

U.S. PATENT DOCUMENTS

| | | | | |
|---|---|---|---|---|
| 4,996,838 | A | 3/1991 | Melconian | |
| 5,025,622 | A | 6/1991 | Melconian | |
| 5,109,671 | A | 5/1992 | Haasis | |
| 5,127,229 | A | 7/1992 | Ishibashi et al. | |
| 5,168,699 | A | 12/1992 | McCarty | |
| 5,231,833 | A | 8/1993 | MacLean | |
| 5,237,813 | A | 8/1993 | Harris | |
| 5,323,602 | A | 6/1994 | Defever | |
| 5,475,979 | A | 12/1995 | Oag et al. | |
| 5,579,645 | A | 12/1996 | Prociw et al. | |
| 5,599,735 | A | 2/1997 | Moslehi | |
| 5,653,109 | A | 8/1997 | Overton | |
| 5,771,696 | A | 6/1998 | Hansel | |
| 5,816,050 | A | 10/1998 | Sjunnesson | |
| 5,934,067 | A | 8/1999 | Ansart et al. | |
| 5,937,653 | A | 8/1999 | Alary et al. | |
| 6,070,410 | A | 6/2000 | Dean | |
| 6,209,325 | B1 * | 4/2001 | Alkabie | F23C 6/047 60/737 |
| 6,253,538 | B1 | 7/2001 | Sampath et al. | |
| 6,508,061 | B2 | 1/2003 | Stuttaford | |
| 6,543,231 | B2 | 4/2003 | Stuttaford et al. | |
| 6,810,673 | B2 | 11/2004 | Snyder | |
| 6,955,053 | B1 | 10/2005 | Chen et al. | |
| 7,448,218 | B2 | 11/2008 | Heilos et al. | |
| 7,509,809 | B2 | 3/2009 | Patel | |
| 7,748,221 | B2 | 7/2010 | Patel et al. | |
| 7,942,006 | B2 | 5/2011 | Critchley et al. | |
| 8,051,664 | B2 | 11/2011 | Fish | |
| 8,091,367 | B2 | 1/2012 | Alkabie | |
| 8,113,001 | B2 | 2/2012 | Singh | |
| 8,307,661 | B2 | 11/2012 | Harris et al. | |
| 9,127,843 | B2 * | 9/2015 | Prociw | F23R 3/06 |
| 2003/0177769 | A1 | 9/2003 | Graves | |
| 2003/0213249 | A1 * | 11/2003 | Pacheco-Tougas | F23R 3/002 60/752 |
| 2005/0076650 | A1 | 4/2005 | Dudebout | |
| 2006/0042263 | A1 | 3/2006 | Patel et al. | |
| 2006/0042271 | A1 | 3/2006 | Morenko | |
| 2006/0196188 | A1 * | 9/2006 | Burd | F23R 3/002 60/754 |
| 2006/0218925 | A1 | 10/2006 | Prociw | |
| 2007/0028620 | A1 | 2/2007 | McMasters et al. | |
| 2007/0130953 | A1 * | 6/2007 | Burd | F23R 3/06 60/772 |
| 2007/0169484 | A1 * | 7/2007 | Schumacher | F23R 3/002 60/754 |
| 2007/0227149 | A1 | 10/2007 | Biebel | |
| 2007/0227150 | A1 | 10/2007 | Alkabie | |
| 2007/0271926 | A1 | 11/2007 | Alkabie | |
| 2008/0104962 | A1 * | 5/2008 | Patel | F23R 3/10 60/752 |
| 2008/0105237 | A1 | 5/2008 | Gandza | |
| 2009/0113893 | A1 | 5/2009 | Li | |
| 2010/0212325 | A1 | 8/2010 | Condevaux et al. | |
| 2010/0281881 | A1 | 11/2010 | Morenko | |
| 2011/0185699 | A1 | 8/2011 | Danis | |
| 2011/0239652 | A1 | 10/2011 | McMahan | |
| 2012/0125004 | A1 | 5/2012 | Parsania et al. | |
| 2012/0234013 | A1 | 9/2012 | Overman | |
| 2012/0240588 | A1 | 9/2012 | Patel et al. | |
| 2014/0190178 | A1 | 7/2014 | O'Donnell | |
| 2014/0238024 | A1 | 8/2014 | Kraemer | |
| 2014/0260266 | A1 | 9/2014 | Prociw | |
| 2014/0260297 | A1 | 9/2014 | Prociw | |
| 2014/0260298 | A1 | 9/2014 | Prociw | |
| 2015/0247641 | A1 | 9/2015 | Patel | |

FOREIGN PATENT DOCUMENTS

| | | | |
|---|---|---|---|
| FR | 2694799 | A1 | 2/1994 |
| GB | 686425 | | 9/1950 |
| WO | 2013023147 | A1 | 2/2013 |

* cited by examiner

COMBUSTOR FOR GAS TURBINE ENGINE

FIELD OF THE INVENTION

The present application relates to gas turbine engines and to a combustor thereof.

BACKGROUND OF THE ART

Fuel sprays in current combustion systems of gas turbine engines are from discrete fuel injectors. Air introduced through fuel injectors and adjacent air swirlers needs to be mixed rapidly with the fuel spray for combustion, and for gaseous and smoke emissions control. The frame fronts in the combustion region are around stoichiometric level and hence generate high temperature zones in the combustor, leading to high nitrogen oxide emissions. Any unmixedness in the fuel-air mixture will result in high smoke and pattern factor, which are not desirable for the environment and hot-section durability.

SUMMARY

In accordance with the present disclosure, there is provided a combustor comprising: an annular combustor chamber formed between an inner liner and an outer liner, an annular upstream zone adapted to receive fuel and air from an annular nozzle, and an annular mixing zone located downstream of the upstream zone, the mixing zone having a reduced radial height relative a downstream combustion zone of the combustion chamber, the mixing zone defined by straight wall sections.

Further in accordance with the present disclosure, there is provided a gas turbine engine comprising: an annular combustor chamber formed between an inner liner and an outer liner, an annular upstream zone adapted to receive fuel and air from an annular nozzle, and an annular mixing zone located downstream of the upstream zone, the mixing zone having a reduced radial height relative a downstream combustion zone of the combustion chamber, the mixing zone defined by straight wall sections.

DESCRIPTION OF THE EMBODIMENT

Figure 1:
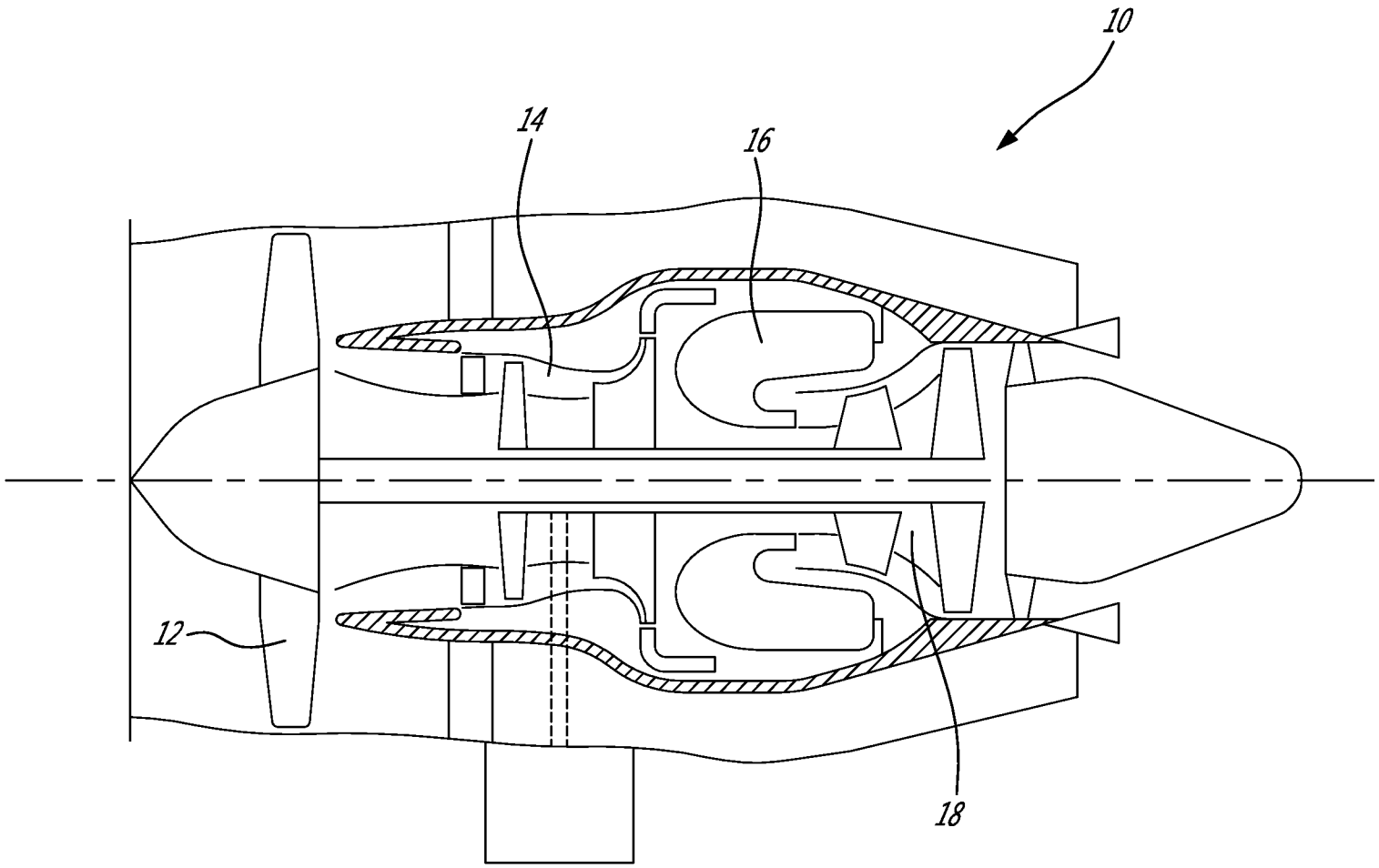
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air within a compressor case 15, a combustor 16 in which the compressed air is mixed with fuel and ignited for generating an annular stream of hot combustion gases, and a turbine section 18 for extracting energy from the combustion gases.

Figure 2:
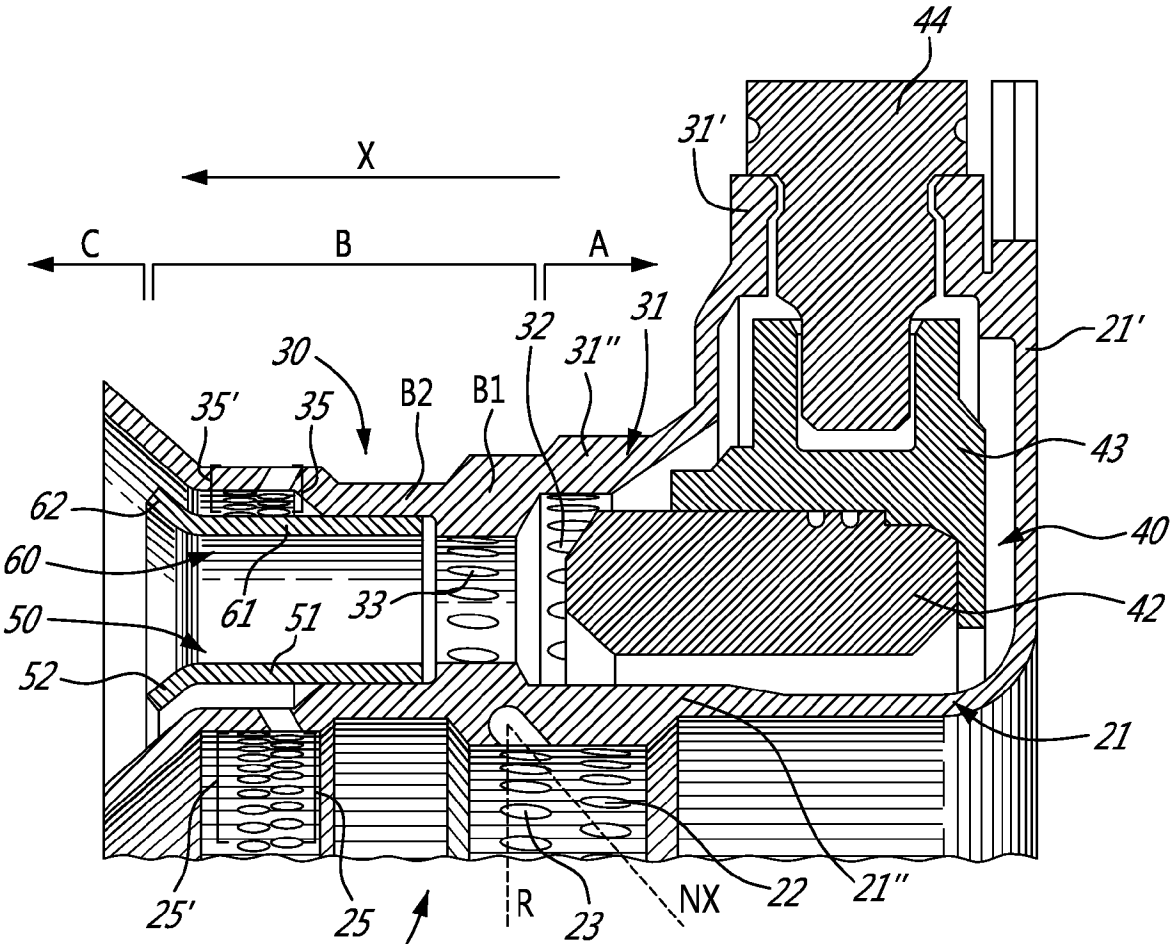
FIG. 2 is a longitudinal sectional view of a combustor assembly in accordance with the present disclosure.
Figure 3:
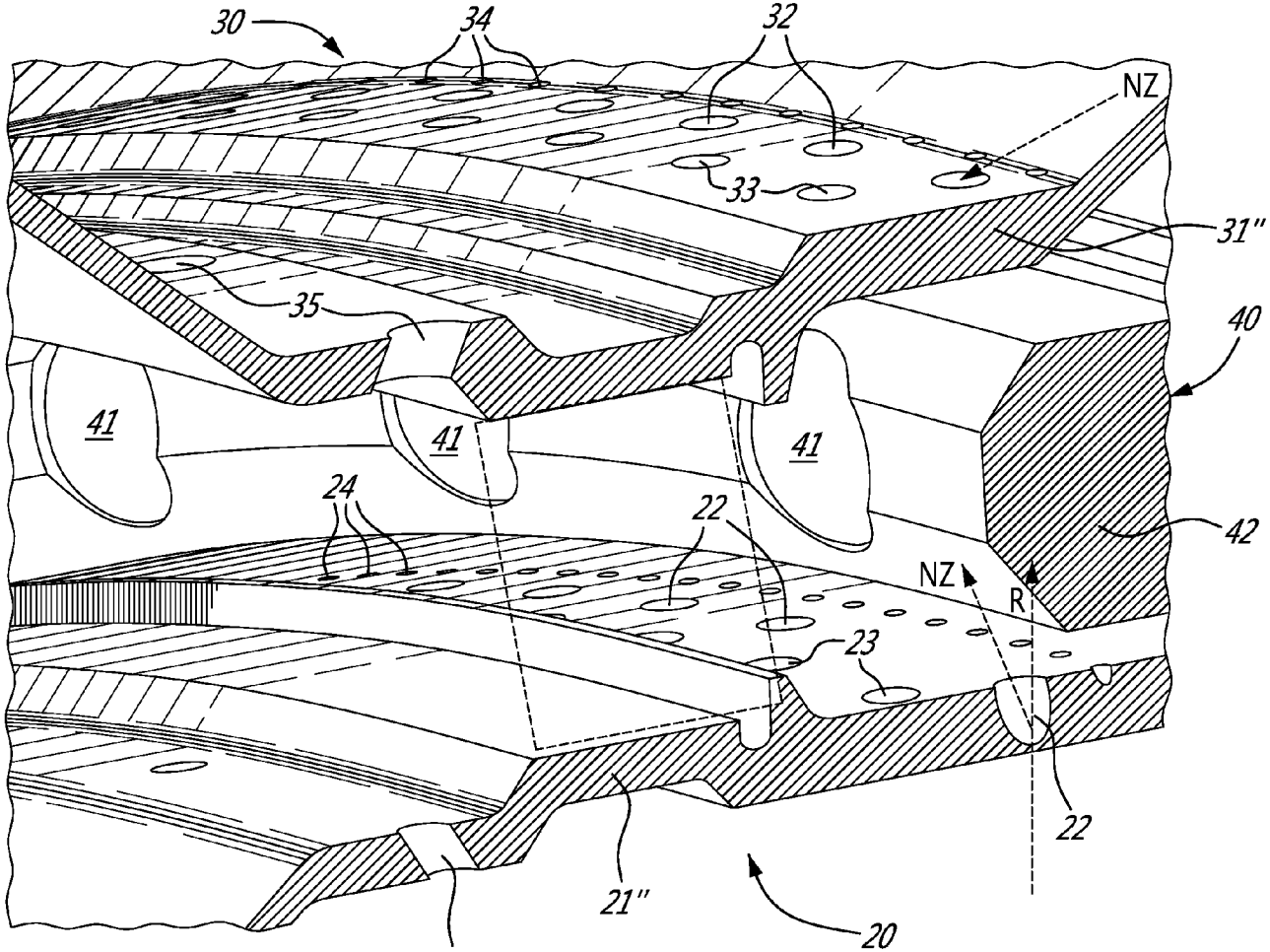
FIG. 3 is a sectional perspective view of the combustor assembly of FIG. 2.

The combustor 16 is illustrated in FIG. 1 as being of the reverse-flow type, however the skilled reader will appreciate that the description herein may be applied to many combustor types, such as straight-flow combustors, radial combustors, lean combustors, and other suitable annular combustor configurations. The combustor 16 has an annular geometry with an inner liner 20 and an outer liner 30 defining therebetween an annular combustor chamber in which fuel and air mix and combustion occurs. As shown in FIGS. 2 and 3, a fuel manifold 40 is positioned inside the combustion chamber and therefore between the inner liner 20 and the outer liner 30.

In the illustrated embodiment, an upstream end of the combustor 16 has a sequence of zones, namely zones A, B, and C. The manifold 40 is in upstream zone A. A narrowing portion B1 is defined in mixing zone B. A shoulder B2 is defined in mixing zone B to support components involved in the mixing of the fuel and air, such as a louver, as described hereinafter. In dilution zone C, the combustor 16 flares to allow wall cooling and dilution air to mix with the fuel and nozzle air mixture coming from the zones B and C of the combustor 16. A combustion zone is downstream of the dilution zone C.

The inner liner 20 and the outer liner 30 respectively have support walls 21 and 31 by which the manifold 40 is supported to be held in position inside the combustor 16. Hence, the support walls 21 and 31 may have outward radial wall portions 21' and 31', respectively, supporting components of the manifold 40, and turning into respective axial wall portions 21" and 31" towards zone B. Nozzle air inlets 22 and 32 are circumferentially distributed in the inner liner 20 and outer liner 30, respectively. According to an embodiment, the nozzle air inlets 22 and nozzle air inlets 32 are equidistantly distributed. The nozzle air inlets 22 and nozzle air inlets 32 are opposite one another across combustor chamber. It is observed that the central axis of one or more of the nozzle air inlets 22 and 32, generally shown as N, may have an axial component and/or a tangential component, as opposed to being strictly radial. Referring to FIG. 2, it is observed that the central axis N is oblique relative to a radial axis R of the combustor 16, in a plane in which lies a longitudinal axis X of the combustor 16. Hence, the axial component NX of the central axis N is oriented downstream, i.e., in the same direction as that of the flow of the fuel and air, whereby the central axis N leans towards a direction of flow (for instance generally parallel to the longitudinal axis X). In an embodiment, the central axis N could lean against a direction of the flow.

Figure 4:
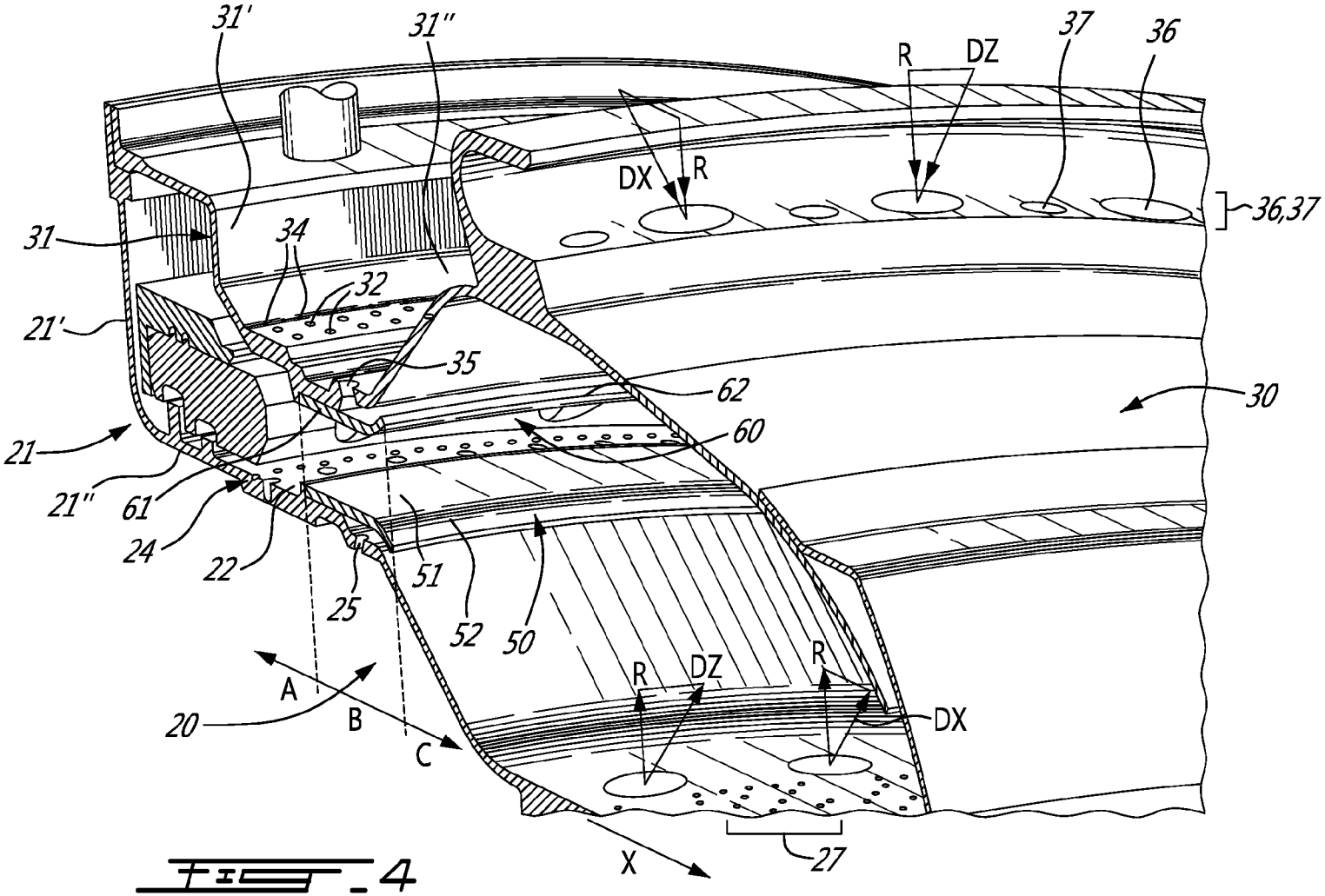
FIG. 4 is another sectional perspective view of the combustor assembly of FIG. 2.

Referring to FIGS. 3 and 4, the central axis N of one or more of the nozzle air inlets 22 and 32 may have a tangential component NZ, in addition or in alternative to the axial component NX. For simplicity, in FIGS. 3 and 4, only the tangential component NZ of the central axis N is shown, although the nozzle air inlets 22 and 32 may have both an axial and a tangential component. The tangential component NZ is oblique relative to radial axis R in an axial plane, i.e., the axial plane being defined as having the longitudinal axis X of the combustor 16 being normal to the axial plane. In FIG. 3, the tangential component NZ is in a counterclockwise direction, while in FIG. 4, the tangential component NZ is clockwise. The tangential component NZ may allow an increase residence time of the air and fuel mixture in the downstream mixing zone B of the combustor 16.

Referring to FIG. 2, nozzle air inlets 23 and 33 may be located in the narrowing portion B1 of mixing zone B. Alternatively, as shown in FIG. 3, the nozzle air inlets 23 and 33 may be in the upstream zone A. The nozzle air inlets 23 and 33 may form a second circumferential distribution of inlets, if the combustor 16 has two circumferential distributions of inlets (unlike FIG. 4, showing a single circumferential distribution). In similar fashion to the set of inlets 22/32, the inlets 23 and 33 are respectively in the inner liner 20 and outer liner 30. The inlets 23 and 33 may be oriented such that their central axes X may have an axial component and/or a tangential component.

Hence, the combustor 16 comprises numerous nozzle air inlets (e.g., 22, 23, 32, 33) impinging onto the fuel sprays produced by the fuel manifold 40, in close proximity to the fuel nozzles, thereby encouraging rapid mixing of air and fuel. The orientation of the nozzle air inlets relative to the fuel nozzles (not shown) may create the necessary shearing forces between air jets and fuel stream, to encourage secondary fuel droplets breakup, and assist in rapid fuel mixing and vaporization.

Purged air inlets 24 and 34 may be respectively defined in the inner liner 20 and the outer liner 30, and be positioned in the upstream zone A of the combustor 16. In similar fashion to the sets of nozzle air inlets 22/32, a central axis of the purged air inlets 24 and 34 may lean toward a direction of flow with an axial component similar to axial component NX, as shown in FIG. 2. Purged air inlets 24 and 34 produce a flow of air on the downstream surface of the manifold 40. As shown in FIGS. 2, 3 and 4, sets of cooling air inlets 25 and 35, and cooling air inlets 25' and 35', respectively in the inner liner 20 and the outer liner 30, may be circumferentially distributed in the mixing zone B downstream of the sets of nozzle air inlets 23 and 33. The cooling air inlets 25, 25', 35, 35' may be in channels defined by the liners 20 and 30 and mixing walls 50 and 60 (described hereinafter). Cooling air inlets 25, 25', 35 and 35' may produce a flow of air on flaring wall portions of the inner liner 20 and outer liner 30.

Referring to FIG. 4, dilution air inlets 26 and 36 are circumferentially distributed in the dilution zone C of the combustor 16, respectively in the inner liner 20 and outer liner 30. According to an embodiment, the dilution air inlets 26 and 36 are equidistantly distributed, and opposite one another across combustor chamber. It is observed that the central axis of one or more of the dilution air inlets 26 and 36, generally shown as D, may have an axial component and/or a tangential component, as opposed to being strictly radial. Referring to FIG. 4, the central axis D is oblique relative to a radial axis R of the combustor 16, in a plane in which lies a longitudinal axis X of the combustor 16. Hence, the axial component DX of the central axis D is oriented downstream, i.e., in the same direction as that of the flow of the fuel and air, whereby the central axis D leans towards a direction of flow (for instance generally parallel to the longitudinal axis X). In an embodiment, the central axis D could lean against a direction of the flow.

Still referring to FIG. 4, the central axis D of one or more of the dilution air inlets 26 and 36 may have a tangential component DZ, in addition or in alternative to the axial component DX. For simplicity, in FIG. 4, one inlet is shown with only the axial component DX, while another is shown with only the tangential component DZ. It should however be understood that the inlets 26 and 36 may have both the axial component DX and the tangential component DZ. The tangential component DZ is oblique relative to radial axis R in an axial plane, i.e., the axial plane being defined as having the longitudinal axis X of the combustor 16 being normal to the axial plane. In FIG. 4, the tangential component DZ is in a counterclockwise direction. It is thus observed that the tangential component DZ of the central axes D may be in an opposite direction than that of the tangential component NZ of the central axes N of the nozzle air inlets 22, 23, 32, and/or 33, shown as being clockwise. The opposite direction of tangential components DZ and NZ may enhance fluid mixing to render the fuel and air mixture more uniform, which may lead to keeping the flame temperature relatively low (and related effects, such as lower NOx and smoke emissions, low pattern factor, and enhanced hot-section durability). The opposite tangential direction of dilution air holes relative to the nozzle air holes cause the creation of a recirculation volume immediately upstream of the penetrating dilution jets, further enhancing fuel-air mixing before burning, in a relatively small combustor volume. It is nonetheless possible to have the tangential components of nozzle air inlets and dilution air inlets being in the same direction, or without tangential components.

Referring to FIG. 4, a plurality of cooling air inlets 27 may be defined in the inner liner 20 and outer liner 30 (although not shown). The outer liner 30 has a set of dilution air inlets 37 in an alternating sequence with the set of dilution air inlets 36. The dilution air inlets 37 have a smaller diameter than that of the dilution air inlets 36. This alternating sequence is a configuration considered to maximize the volume of dilution in a single circumferential band, while providing suitable structural integrity to the outer liner 30.

Referring to FIGS. 2 to 4, the manifold 40 is schematically shown as having fuel injector sites 41 facing downstream on an annular support 42. The annular support 42 may be in the form of a full ring, or a segmented ring. The fuel injector sites 41 are circumferentially distributed in the annular support 42, and each accommodate a fuel nozzle (not shown). It is considered to use flat spray nozzles to reduce the number of fuel injector sites 41 yet have a similar spray coverage angle. As shown in FIGS. 3 and 4, the number of nozzle air inlets (e.g., 22, 23, 32, and 33) is substantially greater than the number of fuel injector sites 41, and thus of fuel nozzles of the manifold 40. Moreover, the continuous circumferential distribution of the nozzle air inlets relative to the discrete fuel nozzles creates a relative uniform air flow throughout the upstream zone A in which the fuel stream is injected.

A liner interface comprising a ring 43 and locating pins 44 or the like support means may be used as an interface between the support walls 21 and 31 of the inner liner 20 and outer liner 30, respectively, and the annular support 42 of the manifold 40. Hence, as the manifold 40 is connected to the combustor 16 and is inside the combustor 16, there is no relative axial displacement between the combustor 16 and the manifold 40.

As opposed to manifolds located outside of the gas generator case, and outside of the combustor, the arrangement shown in FIGS. 2-4 of the manifold 40 located inside the combustor 16 does not require a gas shielding envelope, as the liners 20 and 30 act as heat shields. The manifold 40 is substantially concealed from the hot air circulating outside the combustor 16, as the connection of the manifold 40 with an exterior of the combustor 16 may be limited to a fuel supply connector projecting out of the combustor 16. Moreover, in case of manifold leakage, the fuel/flame is contained inside the combustor 16, as opposed to being in the gas generator case. Also, the positioning of the manifold 40 inside the combustor 16 may result in the absence of a combustor dome, and hence of cooling schemes or heat shields.

Referring to FIGS. 2 and 4, mixing walls 50 and 60 are respectively located in the inner liner 20 and outer liner 30, against the shoulders B2 upstream of the narrowing portion B1 of the mixing zone B, to define a straight mixing channel. The mixing walls 50 and 60 form a louver. Hence, the mixing walls 50 and 60 concurrently define a mixing channel of annular geometry in which the fuel and nozzle air will mix. The mixing walls 50 and 60 are straight wall sections 51 and 61 respectively, which straight wall sections 51 and 61 are parallel to one another in a longitudinal plane of the combustor 16 (i.e., a plane of the page showing FIG. 2). The straight wall sections 51 and 61 may also be parallel to the longitudinal axis X of the combustor 16. Other geometries are considered, such as quasi-straight walls, a diverging or converging relation between wall sections 51 and 61, among other possibilities. For instance, a diverging relation between wall sections 51 and 61 may increase the tangential velocity of the fluid flow. It is observed that the length of the straight wall sections 51 and 61 (along longitudinal axis X in the illustrated embodiment) is several times greater than the height of the channel formed thereby, i.e., spacing between the straight wall sections 51 and 61 in a radial direction in the illustrated embodiment. Moreover, the height of the channel is substantially smaller than a height of the combustion zone downstream of the dilution zone C. According to an embodiment, the ratio of length to height is between 2:1 and 4:1, inclusively, although the ratio may be outside of this range in some configurations. The presence of narrowing portion B1 upstream of the mixing channel may cause a relatively high flow velocity inside the mixing channel. This may for instance reduce the flashback in case of auto-ignition during starting and transient flow conditions. The configuration of the mixing zone B is suited for high air flow pressure drop, high air mass flow rate and introduction of high tangential momentum, which may contribute to reaching a high air flow velocity.

The mixing walls 50 and 60 respectively have lips 52 and 62 by which the mixing annular chamber flares into dilution zone C of the combustor 16. Moreover, the lips 52 and 62 may direct a flow of cooling air from the cooling air inlets 25, 25', 35, 35' along the flaring wall portions of the inner liner 20 and outer liner 30 in dilution zone C.

Hence, the method of mixing fuel and nozzle air is performed by injecting fuel in a fuel direction having axial and/or tangential components, relative to the central axis X of the combustor 16. Simultaneously, nozzle air is injected from an exterior of the combustor 16 through the holes 32, 33 made in the outer liner 30 into a fuel flow. The holes 32, 33 are oriented such that nozzle air has at least a tangential component NZ relative to the central axis X of the combustor 16. Nozzle air is injected from an exterior of the combustor 16 through holes 22, 23 made in the inner liner 20 into the fuel flow. The holes 22, 23 are oriented such that nozzle air has at least the tangential component NZ relative to the central axis X, with the tangential components NZ of the nozzle air of the inner liner 20 and outer liner 30 being in a same direction. Dilution air may be injected with a tangential component DZ in an opposite direction.

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

The invention claimed is:

1. A combustor comprising:

an annular combustor chamber formed between an inner liner and an outer liner, an annular upstream zone adapted to receive fuel and air from an annular nozzle, and an annular mixing zone located downstream of the annular upstream zone and formed by a pair of annular wall portions, the annular mixing zone being radially outward of an inner one of the annular wall portions and being radially inward of an outer one of the annular wall portions, the annular mixing zone having a reduced radial height relative a downstream combustion zone of the combustion chamber and to a maximum radial height of the annular upstream zone, the annular mixing zone defined by straight wall sections of the pair of annular wall portions.

2. The combustor according to claim 1, wherein the straight wall sections are parallel to one another.

3. The combustor according to claim 1, wherein a ratio between a length of the mixing zone to a radial height of the mixing zone is from 2:1 to 4:1.

4. The combustor according to claim 1, wherein the straight wall sections diverge with respect to one another in a downstream direction.

5. The combustor according to claim 1, wherein the straight wall sections are parts of an inner annular wall and outer annular wall respectively positioned against the inner liner and outer liner.

6. The combustor according to claim 5, the inner liner and the outer liner each define a shoulder, with the inner annular wall and outer annular wall being positioned against the shoulders.

7. The combustor according to claim 5, wherein the inner annular wall and the outer annular wall are spaced apart from the inner liner and outer liner, respectively, to form channels between the inner annular wall and the inner liner, and between the outer annular wall and the outer liner.

8. The combustor according to claim 7, further comprising cooling air holes through the inner liner and the outer liner and in fluid communication with said channels.

9. The combustor according to claim 8, wherein the inner annular wall and the outer annular wall each have a flaring wall portion downstream of the straight wall sections to deflect cooling air exiting the channels.

10. The combustor according to claim 5, further comprising nozzle air holes in the inner liner and the outer liner, between a narrowing portion and the annular walls.

11. The combustor according to claim 1, further comprising nozzle air holes in the inner liner and the outer liner in the annular mixing zone.

12. The combustor according to claim 1, further comprising a single fuel manifold, the single fuel manifold having an annular body located inside the annular upstream zone, the annular body having an outer diameter smaller than a diameter of the outer liner, and an inner diameter larger a diameter of the inner liner.

13. A gas turbine engine comprising:

an annular combustor chamber formed between an inner liner and an outer liner, an annular upstream zone adapted to receive fuel and air from an annular nozzle, and an annular mixing zone located downstream of the annular upstream zone and formed by a pair of annular wall portions, the annular mixing zone being radially outward of an inner one of the annular wall portions and being radially inward of an outer one of the annular wall portions, the annular mixing zone having a reduced radial height relative a downstream combustion zone of the combustion chamber and relative to a maximum radial height of the annular upstream zone, the annular mixing zone defined by straight wall sections of the pair of annular wall portions.

14. The gas turbine engine according to claim 13, wherein the straight wall sections are one of parallel to one another and diverging with respect to one another in a downstream direction.

15. The gas turbine engine according to claim 13, wherein the straight wall sections are parts of an inner annular wall and outer annular wall respectively positioned against the inner liner and outer liner.

16. The gas turbine engine according to claim 15, wherein the inner annular wall and the outer annular wall are spaced apart from the inner liner and outer liner, respectively, to form channels between the inner annular wall and the inner liner, and between the outer annular wall and the outer liner.

17. The gas turbine engine according to claim 16, further comprising cooling air holes through the inner liner and the outer liner and in fluid communication with said channels.

18. The gas turbine engine according to claim 13, wherein a ratio between a length of the annular mixing zone to a radial height of the mixing zone is from 2:1 to 4:1, in the combustor.

19. The gas turbine engine according to claim 13, further comprising nozzle air holes in the inner liner and the outer liner in the annular mixing zone.

20. The gas turbine engine according to claim 13, further comprising a single fuel manifold, the single fuel manifold having an annular body located inside the annular combustor chamber, the annular body having an outer diameter smaller than a diameter of the outer liner, and an inner diameter larger a diameter of the inner liner.

* * * * *